United States Patent [19]

Wilde

[11] 4,305,755

[45] Dec. 15, 1981

[54] NOBLE METAL ALLOYING OF STEEL FOR IMPROVED RESISTANCE IN HYDROGEN ATTACK

[75] Inventor: Bryan E. Wilde, Allison Park, Pa.

[73] Assignee: United States Steel Corporation, Pittsburgh, Pa.

[21] Appl. No.: 186,877

[22] Filed: Sep. 12, 1980

Related U.S. Application Data

[63] Continuation-in-part of Ser. No. 49,756, Jun. 18, 1979, abandoned.

[51] Int. Cl.[3] ..... C22C 38/06

[52] U.S. Cl. ..... 75/124; 75/126 R; 75/126 N

[58] Field of Search ..... 75/123 R, 123 N, 126 R, 75/126 B, 126 C, 128 R, 124 B; 148/36

[56] References Cited

FOREIGN PATENT DOCUMENTS 41-1202 1/1966 Japan ..... 148/36

OTHER PUBLICATIONS

Perry et al., Chem. Eng. Handbook, 5th Ed. TP 155 P4, 1973, 23–55.

*Primary Examiner*—M. J. Andrews
*Attorney, Agent, or Firm*—Arthur J. Greif

[57] ABSTRACT

The resistance of AISI 4130-type steels to hydrogen-induced corrosion phenomena is materially enhanced by the addition of at least about 0.3% of a metal selected from the group consisting of platinum, palladium, silver or mixtures thereof.

3 Claims, No Drawings

NOBLE METAL ALLOYING OF STEEL FOR IMPROVED RESISTANCE IN HYDROGEN ATTACK

This application is a continuation-in-part of Application Ser. No. 049,756, filed June 18, 1979 now abandoned.

The application of steel construction materials in environments containing hydrogen sulfide (sour environments) is often severely limited due to hydrogen-induced, localized corrosion attack such as surface blistering, internal fissuring, and stress-corrosion cracking. Each of these localized forms of attack is caused by hydrogen, generated at the surface of the metal as a result of the general corrosion thereof, being absorbed into the metal matrix and interacting with a defect or second phase particle therein. Particularly in these energy-short times, there is a trend towards using such steels in even deeper oil and gas wells and pipelines, containing progressively higher concentrations of hydrogen sulfide—increasing the need for steels which are more resistant to the above-noted hydrogen-induced forms of attack. Since such localized attack can often result in catastrophic failure, the use of high-strength steels can be severely limited. As an alternative to steels and other ferrous-base alloys, nickel and cobalt base alloys, although significantly more expensive, offer both greater resistance to such hydrogen-induced embrittlement as well as outstanding general corrosion (overall weight loss) resistance. It has been shown (Kane et al, *Corrosion,* Volume 33, pages 309 to 320, 1977) however, that even such generally resistant nickel and cobalt base alloys may be susceptible to such hydrogen-induced attack, particularly when such alloys are coupled to steel (an almost inevitable situation in wells and pipelines).

Japanese Patent No. 41-1202 shows that low alloy steels containing about 0.12 to 0.14% C., about 2% Cr and about 0.07 to 0.1% Al can be made more resistant to sulfide stress corrosion cracking by the addition of minor amounts of noble metals, i.e. about 0.006% Pd or 0.06% Ag. It was determined, however, in an AISI 4130-type steel, i.e. those containing higher amounts of carbon (0.25 to 0.4% C.), and lower amounts of chromium (0.5 to 1.2% Cr) and aluminum (<0.02% Al), such minor amounts of noble metals provided essentially no benefits in this regard. Thus, even when Pd or Ag levels more than ten times greater (i.e. 0.14 Pd or 0.605% Ag) than those actually employed in the Japanese patent, were added to an AISI 4130-type steel, no significant benefit was realized. It was discovered, however, that (i) low alloy steels, similar to the AISI 4130-type, can be rendered virtually immune to such hydrogen-induced corrosion attack by the addition of comparatively large amounts of certain noble elements, or (ii) by the use of somewhat lower concentrations than those required to provide total immunity, the resistance of such steels to such hydrogen-induced phenomena may be materially enhanced.

A series of alloys were melted having a base composition similar to that of an AISI 4130-type steel. To the base alloy, single additions to either silver, palladium or platinum were added at nominal levels of 0.05%, 0.1%, 0.5% and 1.0%. The steels were produced by vacuum-induction melting, followed by ingot casting and hot rolling at 1700° F. to 0.5-inch-thick plate. The steels were thereafter heat treated to have similar mechanical properties, which along with the chemical compositions thereof are provided in Table I.

TABLE I

| | | Composition (Percent by Weight) | | | | | | | | | | Mechanical Properties | | | |
|---|---|---|---|---|---|---|---|---|---|---|---|---|---|---|---|
| Designation | Additive | C | Mn | P | S | Si | Cr | Mo | Ag | Pt | Pd | 0.2% Offset Yield Strength | Ultimate Tensile Strength | % Elong. (in 1") | % R/A |
| 2A | Ag | .36 | .587 | .006 | .012 | .286 | 1.155 | .199 | <.0004 | <.01 | <.01 | 103.6 Ksi | 124.9 Ksi | 21.2 | 68.7 |
| 2B | Ag | .36 | .612 | .006 | .012 | .290 | 1.139 | .198 | .062 | <.01 | <.01 | 109.7 Ksi | 126.1 Ksi | 21.3 | 66.9 |
| 2C | Ag | .36 | .584 | .006 | .012 | .290 | 1.149 | .198 | .14 | <.01 | <.01 | 105.7 Ksi | 124.7 Ksi | 21.7 | 68.2 |
| 2D | Ag | .36 | .578 | .005 | .012 | .299 | 1.146 | .197 | .605 | <.01 | <.01 | 107.5 Ksi | 125.9 Ksi | 21.5 | 67.4 |
| 2E | Ag | .36 | .579 | .006 | .011 | .299 | 1.144 | .195 | .99 | <.01 | <.01 | 108.4 Ksi | 128.0 Ksi | 20.7 | 66.0 |
| 3A | Pd | .34 | .612 | .008 | .013 | .306 | 1.203 | .186 | .003 | <.01 | <.01 | 97.3 Ksi | 118.5 Ksi | 22.3 | 69.7 |
| 3B | Pd | .35 | .616 | .008 | .014 | .305 | 1.182 | .184 | .004 | <.01 | .061 | 109.6 Ksi | 128.8 Ksi | 21.2 | 67.9 |
| 3C | Pd | .35 | .612 | .009 | .013 | .320 | 1.191 | .186 | .004 | <.01 | .14 | 107.3 Ksi | 128.2 Ksi | 21.3 | 68.8 |
| 3D | Pd | .34 | .607 | .008 | .013 | .318 | 1.169 | .183 | .004 | <.01 | .60 | 102.3 Ksi | 116.5 Ksi | 22.3 | 66.6 |
| 3E | Pd | .34 | .590 | .008 | .013 | .307 | 1.129 | .183 | .005 | <.01 | 1.25 | 108.0 Ksi | 123.1 Ksi | 20.2 | 68.9 |
| 4A | Pt | .36 | .588 | .006 | .014 | .28 | 1.121 | .192 | <.0004 | <.01 | <.01 | 110.4 Ksi | 131.4 Ksi | 20.3 | 68.4 |
| 4B | Pt | .36 | .59 | .006 | .013 | .288 | 1.123 | .191 | <.0004 | .053 | <.01 | 110.7 Ksi | 132.0 Ksi | 20.3 | 68.4 |
| 4C | Pt | .35 | .573 | .006 | .012 | .288 | 1.111 | .190 | <.0004 | .10 | <.01 | 111.1 Ksi | 132.0 Ksi | 20.5 | 68.6 |
| 4D | Pt | .35 | .569 | .006 | .011 | .28 | 1.098 | .189 | <.0004 | .50 | <.01 | 101.9 Ksi | 122.9 Ksi | 21.8 | 67.2 |
| 4E | Pt | .35 | .551 | .006 | .011 | .275 | 1.090 | .187 | <.0004 | 1.02 | <.01 | 113.0 Ksi | 133.5 Ksi | 20.8 | 66.2 |

Results from two kinds of stress corrosion cracking tests; (a) dynamic displacement and (b) uniaxial tension (for the details of such test procedures, see, for example, B. E. Wilde, M. J. Doyle, *Corrosion,* June, (1979), also A. W. Loginow, Materials Protection, Vol. 5, No. 5., p. 33–39, 1966) are provided in Table II. Internal fissuring tests, commonly referred to as hydrogen-induced blister cracking ("HIBC"), along with the above-noted stress-corrosion tests, were conducted in a standard NACE solution containing; 0.5% acetic acid and 3.5% sodium chloride saturated with hydrogen sulfide at 25° C.

TABLE II

| Alloy Designation | Solute Additive (Nominal) percent. | Crack-Initiation Stress-Intensity, ($K_{initiation}$) Ksi $\sqrt{inch}$ | Time to Failure at 100% of the Yield Strength hours |
|---|---|---|---|
| 2A | <.01 Ag | 40 | 11.2 |
| 2B | 0.05 Ag | 41 | 10.6 |
| 2C | 0.1 Ag | 40 | 12.6 |
| 2D | 0.5 Ag | 41 | 15.8 |
| 2E | 1.0 Ag | 76 | No failure in 500 hours |
| 3A | <.01 Pd | 45 | 8.1 |
| 3B | 0.05 Pd | 47 | 7.2 |
| 3C | 0.1 Pd | 53 | 5.1 |
| 3D | 0.5 Pd | 72 | No failure in 600 hours |
| 3E | 1.0 Pd | >100 No cracking | No failure in |

TABLE II-continued

| Alloy Designation | Solute Additive (Nominal) percent. | Crack-Initiation Stress-Intensity, ($K_{initiation}$) Ksi $\sqrt{inch}$ | Time to Failure at 100% of the Yield Strength hours |
|---|---|---|---|
| | | | 600 hours |
| 4A | <.01 Pt | 42 | 11.0 |
| 4B | 0.05 Pt | 43 | 12.3 |
| 4C | 0.1 Pt | 49 | 53.0 |
| 4D | 0.5 Pt | >100 No cracking | No failure in 502 hours |
| 4E | 1.0 Pt | >100 No cracking | No failure in 527 hours |

Referring to Table II, results of (a) the dynamic displacement tests show that a significant increase in $K_{init.}$ occurs at the nominal 1% silver level—although cracking still did initiate. In the case of the palladium-containing alloy, an increase in $K_{init.}$ appeared at about 0.5%, with immunity to cracking observed at the 1% level. Similarly, immunity to cracking was also noted at the 0.5 and 1% platinum level. The results of (b) the uniaxial-tension tests corroborate the above findings. Thus, times to failure, when stressed at 100% of the yield strength, indicate that immunity to cracking is achieved at the 1% nominal silver level, and at a level of 0.5% or above both for the platinum or palladium containing alloys. As noted above, HIBC tests were also run. In the case of silver, no significant beneficial influence on HIBC was noted. However, in the case of the 1% nominal levels for platinum and palladium, complete immunity was observed in both instances, even after a 2000-hour exposure period in the quite severe NACE test environment. Although the enhanced resistance to sulfide stress-corrosioncracking provided by the noble elements is not clearly understood, electrochemical experiments and ion-beam surface implantation techniques have shown that the beneficial role provided by these elements is not at the matrix-environment interface, and thus must result from a modification of the matrix structure itself and the interaction therewith of dissolved hydrogen.

The amount of noble metal added, would of course depend on (i) the specific environment in which the alloy were to be employed and (ii) the degree of resistance desired, in light of the additional cost encountered as a result of such noble-metal addition. Thus, while 1% (or greater) of either platinum or palladium would provide immunity to all forms of hydrogen-induced attack in virtually any environment, the costs of such an alloy would likely be prohibitive, except for very limited situations. Since the 0.5% nominal level of these additives provided immunity to stress-corrosion cracking, there would clearly be many situations in which this level of addition, or even somewhat lower, e.g. 0.3% would provide an optimum combination of enhanced resistance and cost effectiveness. On the other hand, while silver does not provide the same degree of resistance, on an equivalent weight-percentage basis; its significantly lower cost permits the use thereof, in a practical sense, within the range 0.75 to 2.0%, or even greater.

The steels to which this invention relates are low-alloy steels, i.e. those containing a total of less than 4% alloy elements, and consisting essentially of 0.25 to 0.4% C., 0.4 to 1% Mn, 0.5 to 1.2% Cr, 0.1 to 0.3% Mo and <0.03% Al. As a result of the poisoning/promoting effect of antimony, tin and arsenic on the hydrogen evolution/absorption reaction as well as their influence on temper embrittlement, it is desirable that these elements be maintained at the respective levels of: Sb...0.05% max. (preferably<0.0015%), Sn...0.01% max. (preferably<0.007%) and As...0.01% max. (preferably <0.007%), wherein the total of these elements is 0.0250% max. (preferably<0.015%).

I claim:

1. A low-alloy steel consisting essentially of 0.25 to 0.4% C., 0.5 to 1.2% Cr, less than 0.03% Al, less than 0.005% Sb, less than 0.01% Sn, less than 0.01% As, wherein the combined total of said Sb, Sn and As is not greater than 0.025%, and at least about 0.3% of an element selected from the group consisting of Pt, Pd or mixtures thereof, and in an amount effective to provide materially-enhanced resistance to hydrogen-induced attack.

2. The composition of claim 1, in which said element is selected from the group of Pt and Pd, in an amount between 0.5 and 1.0%.

3. A low-alloy steel consisting essentially of 0.25 to 0.4% C., 0.5 to 1.2% Cr, less than 0.03% Al, less than 0.005% Sb, less than 0.01% Sn, less than 0.01% As, wherein the combined total of said Sb, Sn and As is not greater than 0.025%, and from about 0.75 to 2.0% Ag, and in an amount effective to provide materially-enhanced resistance to hydrogen-induced attack.

* * * * *